US005598645A

United States Patent [19]

Kaiser

[11] Patent Number: 5,598,645

[45] Date of Patent: Feb. 4, 1997

[54] SHOE SOLE, IN PARTICULAR FOR SPORTS SHOES, WITH INFLATABLE TUBE ELEMENTS

[75] Inventor: Otmar Kaiser, Pegnitz, Germany

[73] Assignee: Adidas AB, Germany

[21] Appl. No.: 375,519

[22] Filed: Jan. 18, 1995

Related U.S. Application Data

[63] Continuation of Ser. No. 108,619, Aug. 27, 1993, abandoned.

[30] Foreign Application Priority Data

Jan. 2, 1992 [DE] Germany ..... 9200013 U

[51] Int. Cl.[6] ..... A43B 13/20

[52] U.S. Cl. ..... 36/29; 36/28; 36/35 B

[58] Field of Search ..... 36/29, 28, 27, 36/25 R, 35 R, 35 B

[56] References Cited

U.S. PATENT DOCUMENTS

| | | | |
|---|---|---|---|
| Re. 34,102 | 10/1992 | Core et al. | 36/29 |
| 1,154,491 | 9/1915 | Deol | 36/153 |
| 2,605,560 | 8/1952 | Gouabault . | |
| 2,627,676 | 2/1953 | Hack | 36/29 |
| 4,319,412 | 3/1982 | Miller et al. | 36/29 |
| 4,358,902 | 11/1982 | Core et al. | 36/35 B |
| 4,577,417 | 3/1986 | Cole | 36/29 |
| 4,610,099 | 9/1986 | Signori | 36/29 |
| 4,670,995 | 6/1987 | Huang | 36/44 |
| 4,676,010 | 6/1987 | Cheskin | 36/32 R |
| 4,694,591 | 9/1987 | Banich et al. | 36/102 |
| 4,856,208 | 8/1989 | Zaccaro | 36/29 |
| 4,936,029 | 6/1990 | Rudy | 36/29 |
| 5,014,449 | 5/1991 | Richard | 36/28 |
| 5,199,191 | 4/1993 | Mormojian | 36/29 |
| 5,406,719 | 4/1995 | Potter | 36/35 B |

FOREIGN PATENT DOCUMENTS

| | | | |
|---|---|---|---|
| 200963 | 12/1958 | Austria | 36/153 |
| 1164820 | 10/1958 | France | 36/29 |
| 188808 | 9/1907 | Germany . | |
| 829265 | 1/1952 | Germany . | |
| 1287477 | 1/1969 | Germany . | |
| 16143 | of 1891 | United Kingdom | 36/29 |
| 2073006 | 10/1981 | United Kingdom . | |

*Primary Examiner*—Marie D. Patterson
*Attorney, Agent, or Firm*—Robert W. Strozier

[57] ABSTRACT

A shoe sole having a sole plate with a ground-engaging side having inflatable tube elements secured thereto. The shoe sole also includes upstanding lateral support walls that define a chamber or an installation space which is in communication with the tube elements by means of inflation openings. Also disposed in the installation space is a valve housing, a miniature pump, and connecting conduits connecting the pump to the inflation openings. The tube elements are provided along medial and lateral edges of the sole, and in the heel region. In addition, the tube elements are inflatable separately from each other so that it is possible to individually adjust the tread characteristics of a shoe provided with the shoe sole. The tube elements further include a longitudinal partition which divides the interior thereof into two air chambers which communicate with each other through at least one opening in the longitudinal partition. That provides improved tread characteristics and increased rigidity of the tube elements.

8 Claims, 2 Drawing Sheets

SHOE SOLE, IN PARTICULAR FOR SPORTS SHOES, WITH INFLATABLE TUBE ELEMENTS

This application is a continuation of U.S. patent application Ser. No. 08/108,619, filed Aug. 27, 1993, now abandoned.

BACKGROUND OF THE INVENTION

1. Field of the Invention

The invention relates to a shoe sole, in particular for sports shoes.

2. Description of the Related Art

In a known shoe sole (German patent specification No. 829 265), the tread surface of the sole is formed by a tube element which is arranged on the foresole and which can be inflated by means of an air pump. A valve fitment is disposed in the arch region on the underside of the sole for inflating the tube element. A recess is provided in which the valve can be disposed when not in use. The tube element forms a closed ring and is contoured to approximately correspond to the contour of the edge of the foresole and extends parallel thereto. The tube element defines a single closed chamber. The result is that in the course of the rolling movement associated with walking or running, the weight of the user causes air to be displaced out of the part of the tube element which is primarily subjected to a loading and into the less heavily loaded part thereof. That displaced air can result in a floating feeling which gives rise to instability. In order to correct that, the tube element can be inflated to a relatively high pressure, but it then loses its soft tread action which is desired for a damping effect.

In another known shoe sole (U.S. Pat. No. 2,605,560), the ground-engaging side of the foresole and the heel portion are each formed by a respective air cushion which, with the exception of a narrow edge region, occupies the entire surface area of the foresole and the heel portion respectively. Unlike a tube element in the above-described known shoe sole whose width is small in relation to the width of the sole, each air cushion in that known shoe sole bears against the ground practically over the width of the sole and in an undefined fashion. As a result, the tendency of air to be displaced from a loaded region of the air cushion to a less loaded region thereof is made still more pronounced and there is no guarantee that the foot is satisfactorily guided in its rolling movement.

SUMMARY OF THE INVENTION

The object of the present invention is to design a shoe sole of the kind set forth in the opening part of this specification, in such a way that in particular it satisfies the requirements which are to be made in regard to a sports shoe or running shoe, that is to say it affords a damping action, a support action and a guide action while running, and in that respect can be individually adapted to the needs of the runner.

In accordance with a number of aspects of the present invention, that object is attained by the configurations set forth in the appended claims.

Unlike the known shoe soles discussed above, the shoe sole according to the invention, has a continuous sole plate which does not carry any separate heel portion projecting downwardly relative to the foresole. On the contrary, projecting upwardly from the foot side of the sole plate, approximately following the oppositely disposed edges of the sole, are support walls which—on the finished shoe—transmit the loading which occurs in use to the sole plate and by way of the latter to downward projecting tube elements. Provided between the support walls is a chamber or installation space which serves to accommodate a valve housing and connecting conduits which extend therefrom to the individual tube elements. The sole plate comprises a relatively hard but flexurally resilient plastic material and the support walls provided thereon are preferably formed integrally therewith and consequently have the same material property. The support walls in conjunction with the sole plate therefore provide for holding and guiding the foot in the rolling movement thereof while the sole portions disposed therebeneath, in the form of tube elements, have essentially only a damping function. Due to the arrangement of the valve housing and the connecting conduits, and the position of the inflation openings in the installation space, those parts or devices are arranged in such a way as to be protected from external influences and therefore in regard to their function cannot be adversely affected by use of the shoe.

In accordance with an advantageous development of this aspect of the invention, the height of the support walls decreases from the heel region towards the foresole, so that it becomes zero approximately at the rearward end of the foresole. The installation space also decreases in height in a corresponding manner, in a wedge-like configuration in a forward direction. Therefore the sole plate with the installation space replaces the wedge-shaped intermediate sole or midsole which is usually provided in sports shoes, but without having the damping function thereof, which, as already explained above, is performed primarily by the tube elements which are fixed on the ground-engaging side of the sole. In spite of the use of a relatively hard flexurally resilient material, the sole plate with the support walls secured thereto can generally be kept light because the installation space is substantially air-filled.

In order to improve the capacity of the side walls to transmit lateral forces, in accordance with an advantageous development it is provided that the support walls extend in a corrugated configuration in plan view and accordingly form one or more bay or indentation portions which project inwardly, that is to say towards the longitudinal center of the sole. In that arrangement the bay portions are covered by support surfaces which desirably rise from the inside outwardly and which serve to hold and connect the underside of the shoe upper, for example the insole, to the last seam.

In accordance with another development of this first aspect of the invention, a miniature pump which can be actuated from the exterior is integrated into the valve housing. In that way the user of a shoe provided with the shoe sole according to the invention can adjust the air pressure in the tube elements, and thus the damping capability, in accordance with the individual requirements of the user and in particular in consideration of the ground conditions encountered, without the need for separately carrying an air pump. Miniature pumps of the kind involved here, for example diaphragm or piston pumps, are known and can be of a very lightweight construction so that the increase in weight of the shoe sole, due to the pump, is not substantial.

In accordance with a second aspect of the invention, for which protection is claimed separately, the tube elements which are arranged separately in the heel region and on the foresole respectively have lateral and medial elements or portions associated with a medial edge and a lateral edge of the sole and can also be inflated separately from each other. The tube elements thereof are possibly subdivided into tube element portions which can be inflated separately from each other. In that way it is possible to provide for different air pressures in the tube elements at the medial edge and the lateral edge respectively of the sole, to provide for control of pronation or supination respectively, and to effect further adaptation to the individual needs of the individual runner. In that way, the position of the sole plate with the support walls and the shoe upper disposed thereon can also be influenced relative to the ground, during the rolling movement of the shoe, so that in that respect the tube elements nonetheless perform a part of the guide function of the shoe sole. It will be appreciated that, for the purposes of separately inflating the tube elements or the tube element portions, a suitable number of inflation openings open into the installation space, and those openings are connected by a corresponding number of connecting conduits to the valve housing or to the miniature pump. Alternatively, the tube elements themselves are provided with inflation openings and valves disposed therein.

In accordance with a third aspect of the invention, it is provided that the tube elements include a longitudinal partition which extends approximately centrally along the interior thereof subdividing each tube element into two chambers which extend in the longitudinal direction of the tube element. Provided in the longitudinal partition is at least one opening through which the two chambers in each tube element communicate with each other. The longitudinal partition provides for adequate stability of the shape of the tube elements so that, even with a relatively high air pressure therein (for example two bars above the external pressure), the tube elements experience only a slight change in their shape and volume. As a result the ground-engaging characteristics of the shoe sole are not substantially altered due to changes in pressure for the purposes of adapting the shoe sole to a different surface. In addition the longitudinal partition also affords an adequate support capability in the event that, as a result of damage to a tube element, the tube element no longer holds its pressure, so that the shoe can still be used at least to a certain extent until the tube element has been repaired or replaced.

Further advantages and features of the invention will be apparent from the following description of an embodiment with reference to the accompanying drawings, and from further appendant claims.

DETAILED DESCRIPTION OF THE PREFERRED EMBODIMENTS

Figure 1:
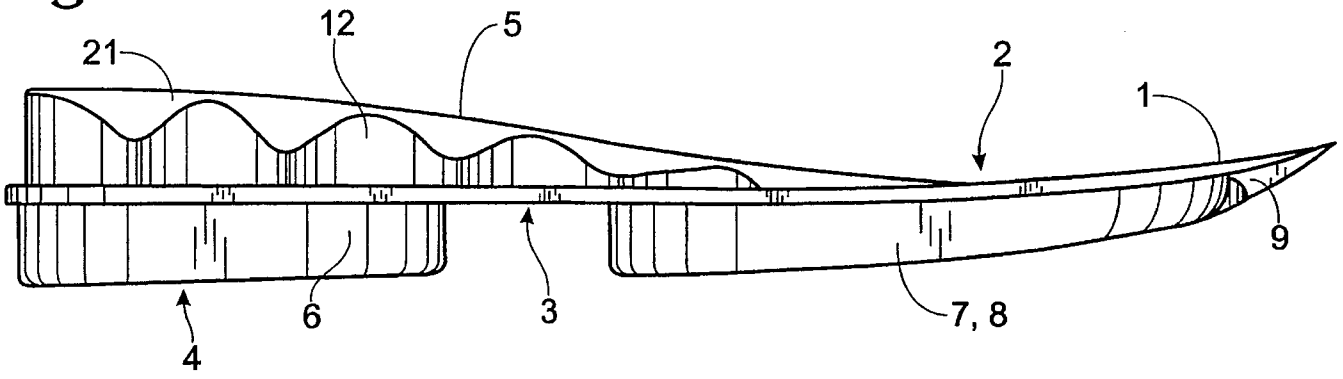
FIG. 1 is a side view of a shoe sole according to the invention.
Figure 2:
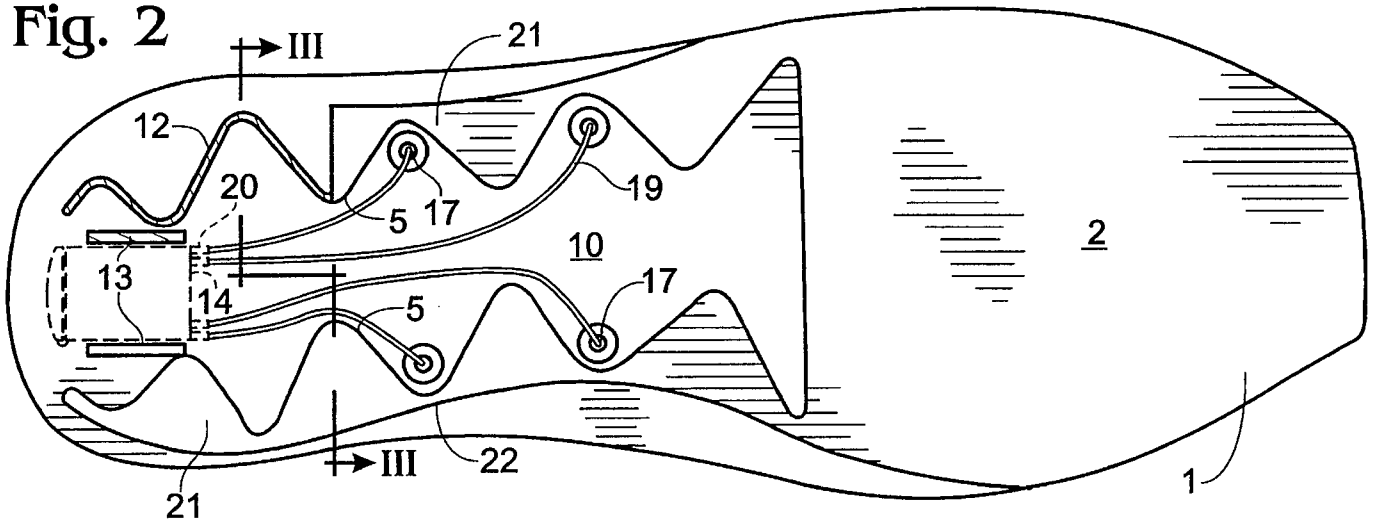
FIG. 2 is a plan view of the shoe sole shown in FIG. 1, in partial section taken along line II—II in FIG. 3.

The embodiment of a shoe sole according to the invention, as illustrated in the drawings, essentially comprises a continuous sole plate 1 comprising a hard, flexurally resilient plastic material, for example hard-set polyamide, having a foresole region 2, an arch region 3 and a heel region 4. Support walls which are generally identified by reference numeral 5 and which, in broad terms approximately follow the associated edge of the sole plate 1 are provided. The sole also includes a tube element 6 at the heel end, as well as a medial tube element 7 and a lateral tube element 8 at the foresole 2. Unlike flat voluminous air cushions, the tube elements 6, 7, 8 are of a relatively slight transverse extent in comparison with their length (i.e., elongate) and the width of the sole, so that it is possible for at least two tube elements or—when the tube elements are of a curved shape—two portions of a tube element to be fixed to the sole plate 1 one beside the other at a spacing from each other (see FIG. 4).

As can be seen from FIG. 1, the height of the support walls 5 at both sides decreases from the apex of the heel configuration to the rearward end portion of the foresole 2 in a slightly curved wedge-like shape so that an installation space 10 formed therebetween correspondingly decreases in respect to its height and disappears approximately at the rearward edge of the foresole region 2. To increase the stiffness of the support walls 5 at both sides, relative to lateral forces, and to increase their load-carrying capability relative to vertical loadings, the support walls 5, in plan view, are of a corrugated or wave-like shape so that indentation or bay portions 12 are formed, which project inwardly, that is to say towards the middle or proximal, longitudinal axis of the sole. In the illustrated embodiment, each of the support walls 5 on both sides forms four bay portions 12 which project inwardly approximately by the same amount. Provided at the oppositely disposed apex points of the two rearmost bay portions 12, in the installation space 10, are two vertically upwardly projecting, flat holding plates 13 which are formed integrally with the sole plate 1 and the support walls 5 and which serve to secure a miniature piston pump 14, which is only indicated in the drawing, with an integrated valve arrangement.

The thickness of the sole plate 1 is approximately uniform throughout and is about 2 mm. However, provided on the ground-engaging side of the sole plate 1 are edge portions 16 which project downwardly by a further distance of about 2 mm and the configuration of which substantially corresponds to the contour of the tube elements 6, 7 and 8 which are to be fitted therebetween. Provided in the region enclosed by the edge portions 16 are inflation openings 17 which pass through the sole plate 1 and open on the foot side thereof into the installation space 10. The inflation openings 17, on the side towards the foot the sole plate 1, are locally reinforced in the form of small projections or holders in which small pipe connections are arranged for fitting thereto connecting-tubes or hoses 19. The connecting-tubes 19 each lead to a respective one of four pressure connections 20 of the miniature piston pump 14. Disposed on the ground-engaging side are recesses which are formed in the holders and into which fitments (not shown) on the tube elements are air-tightly inserted. The tube elements are also glued in position. In a departure from that configuration, it is also possible for connecting-nipples to be directly embedded into the sole plate 1, in an upward direction. The connecting nipples form the above-mentioned small pipe connections and also project downwardly. The downwardly projecting nipple portion is desirably thicker than the upwardly projecting pipe connection, it projects into a corresponding opening in the associated tube element and seals that opening off.

The bay portions 12 of the corrugated support walls 5 are covered by support surfaces 21 which, laterally towards the outside edge, project slightly beyond the outer apex points of the corrugation configurations of the support walls 5, and determine the contour 22 of the side of the shoe sole which is towards the foot. It can be seen from FIG. 3 that the support surfaces 21, to which the underside of a shoe upper (not shown) is subsequently connected, rise from the inside outwardly in a concavely curved configuration in order thereby to preform a foot bed at least in the heel region of the shoe sole.

Figure 3:
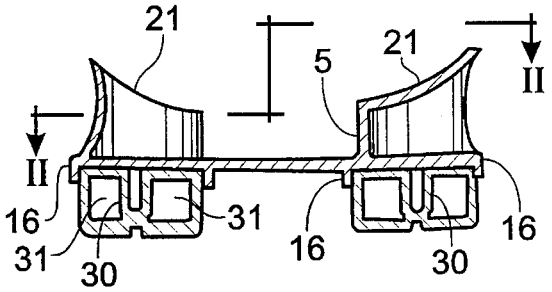
FIG. 3 is a view in section taken along line III—III in FIG. 2.
Figure 4:
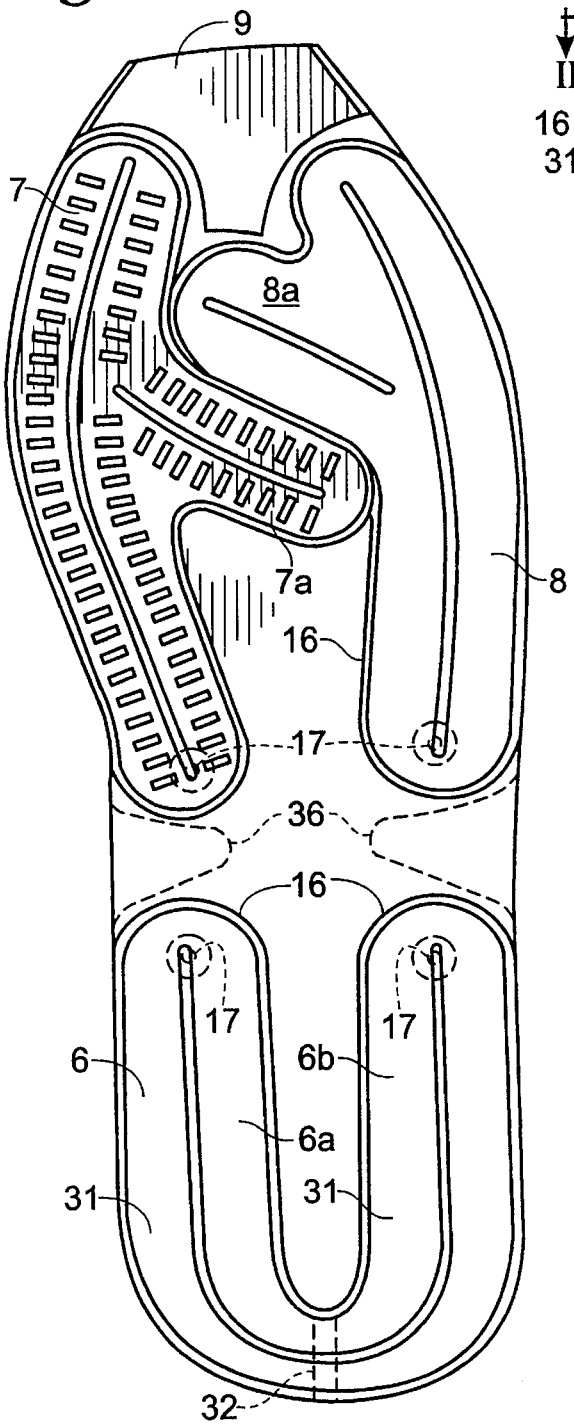
FIG. 4 is a view from below of the shoe sole shown in FIG. 1, showing the configuration of the tube elements secured thereto.

The shape and arrangement of the tube elements 6, 7, 8 can be seen from FIGS. 3 and 4 which show profiling of the tube element 7 only, for the sake of simplicity of the drawing. However, all the tube elements have a profiling configuration in order to improve the non-slip characteristics of the sole.

In comparison with the width of the sole, the tube elements 6, 7 and 8 are of a relatively small transverse extent so that they can be fixed to the underside of the sole plate at a transverse spacing from each other. All tube elements 6, 7 and 8 are of a substantially rectangular cross-section (see FIG. 3); that provides that each tube element has a tread surface of a width corresponding to the width of the tube elements, even in the unloaded condition. By virtue of that approximately rectangular cross-sectional shape, each tube element has an increased level of resistance to a lateral rolling-over movement so that it is possible to achieve a pronounced effect in terms of preventing excessive pronation and/or supination. However it is also possible for a rectangular edge 33 to be provided only at one side of the cross-sectional configuration. For example, for the purposes of controlling pronation, a medial portion 6a of the tube element 6 and the medial tube element 7 have the rectangular edge 33, whereas the opposite side of the tube element cross-section is rounded, as is shown in FIG. 5.

Figure 5:
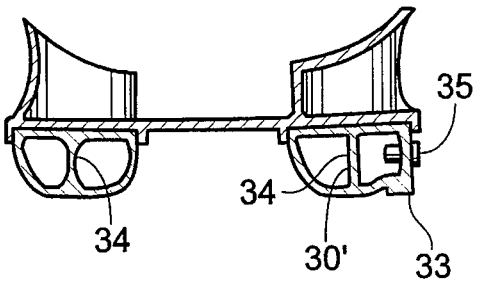
FIG. 5 is a view in section similar to FIG. 3, with a modified embodiment of the tube elements.

All tube elements are subdivided by a respective longitudinal partition 30 and 30' into two chambers 31 which extend parallel to each other and which communicate with each other through at least one opening 34 which is only shown in FIG. 5. In the embodiment shown in FIGS. 1 through 4, the longitudinal partition 30 is of a U-shaped configuration in cross-section and serves to stabilize the tube elements 6, 7, and 8 in a lateral direction, so that the runner does not suffer from a floating feeling when there is a relatively low pressure in the tube elements. The above-mentioned opening in the longitudinal partition 30 is preferably disposed in the region of the inflation openings 17 (FIG. 4). As FIG. 3 shows, the longitudinal partition 30 is connected to the surface forming the inward base of the respective tube element.

The tube element 6 in the heel region is in the shape of a horseshoe and extends along the contour of the heel region of the sole plate 1 (see FIG. 4). It is also divided by a transverse partition 32 into the medial tube element portion 6a and a lateral tube element portion 6*b*. The transverse partition 32 is disposed approximately at the apex of the heel and closes off relative to each other the chambers 31 provided in each of the tube element portions 6*a*, 6*b*.

The tube elements 7 and 8 on the foresole 2 extend fairly accurately along the lateral and medial edges of the sole, but they have inwardly projecting branch portions 7*a* and 8*a* respectively which cover over the ball region and which are arranged one directly in front of the other (see FIG. 4). Adjoining the two front tube elements 7 and 8, towards the tip of the sole, is a locally thickened portion 9 of the sole plate 1, which terminates in a sharp point at the tip of the sole, and which with its ground-engaging side forms a continuous extension of the tread surface of the front tube elements 7 and 8 (see FIG. 1). It is also possible for the thickened portion 9 to be in the form of a sole element which is fixed in position and which comprises a material which is deformable under pressure.

The miniature piston pump 14 which is fixed in the heel region between the two holding plates is not subject-matter of the present invention in regard to the specific design configuration thereof. It is sufficient to point out that it includes a control device for a valve arrangement which permits a communication between a respective one of the four pressure connections 20 to the cylinder in the pump housing, so that the tube element portions 6*a*, 6*b* and the tube elements 7 and 8 can be individually inflated. The valve arrangement includes valves (not shown) which are associated with the individual pressure connections 20 and which prevent escape of the air in the tube elements and which can also be specifically and deliberately actuated, in order possibly to let air out of the tube elements.

In accordance with the invention, it is possible to deviate from details of the above-described embodiment, without thereby departing from the concept of the invention. Thus, instead of the valve arrangement which is associated with the miniature pump and which permits distribution of the compressed air to the individual tube elements 6, 7 and 8 by way of the pressure connections 20, it is possible for each of the tube elements to be provided with an inflation opening accessible from the exterior, and a valve 35 arranged therein (see FIG. 5). In that case, known valves which are designed in the manner of lip valves, as are also used in balls for playing sports, can be used to particular advantage. The use of lip valves of that kind for inflating air chambers on shoe soles is known per se and therefore does not need to be described in greater detail at this point.

It is also possible to envisage disposing the valve arrangement or the miniature pump 14 connected thereto at another location in the installation space 10, for example in one of its lateral regions. The configuration of the tube elements 7 and 8 is also not restricted to that shown in FIG. 4. Thus, it may be sufficient to provide an inwardly directed branch portion 7*a* only on the medial tube element 7, that is to say, to support only the inside ball region of the foot in that way, whereas the tube element 8 associated with the lateral edge of the sole plate 1 does not have such a branch portion so that it extends substantially linearly along the lateral edge of the sole. In addition, instead of a plurality of bay portions 12 in the lateral support walls 5, it is possible to provide only one bay portion 12 in each of the medial and lateral support walls 5 respectively, being disposed in the arch region 3 over the intermediate space which is formed between the rearward ends of the tube elements 7, 8 and the front ends of the tube element 6 (see FIG. 1). A recess 36 in the sole plate 1, which projects inwardly from the lateral edge of the sole, could also be associated with each bay portion 12, as is indicated in broken lines in FIG. 4. That promotes the capacity for twisting movement of the described shoe sole about an axis extending in the longitudinal direction of the sole, in the arch region 3, that is to say, twistability of the foresole region 2 relative to the heel region 4.

Finally, the transverse partition 32 in the tube element 6 in the heel region may be displaced from the apex point of the heel towards the medial side so that the volumes of the tube element portions 6*a* and 6*b* are of different magnitudes. That can improve the damping characteristics of the lateral tube element portion 6*b* which first comes into contact with the ground when the shoe meets the ground, irrespective of the air pressure obtaining in those tube element portions.

I claim:

1. A shoe sole, comprising:

(a) a sole plate having a lower surface; and (b) an elongate, horseshoe-shaped tube element adapted to be inflated with air and form a sole tread surface, each element being subdivided by a longitudinal partition into two chambers which extend in the longitudinal direction of the tube element and which are communicated with each other through at least one opening in the longitudinal partition, the tube element including a transverse partition internally subdividing the element to form a medial and lateral tube element portion having interior cavities that are closed off relative to each other.

2. The shoe sole of claim 1 wherein the sole tread surface includes a profiling configuration.

3. A shoe sole, comprising:

(a) an elongate sole plate having a foot side and a ground engaging side;

(b) at least one tube element secured to the ground engaging side of the sole plate that is inflatable to form a sole tread surface;

(c) support walls which project upwardly from the foot side of the sole plate along a heel and arch region thereof and which define a chamber having a valve housing and conduits located therein; and (d) at least one inflation opening in communication with the at least one tube element and the chamber;

(e) wherein the support walls include lateral and medial support walls and support surfaces for supporting an underside of a shoe upper which is to be joined to the shoe sole, the support surfaces covering over at least one bay portion which projects inwardly towards a proximal, longitudinal axis of the sole, the support surfaces extend in a rising configuration from an inner apex point of the bay portions towards the respectively associated edge of the sole.

4. The sole of claim 3, wherein one tube element is associated with a heel portion of the sole and one tube element is associated with a foresole portion of the sole.

5. The sole of claim 3, wherein one tube element is associated with a heel portion of the sole and two tube elements are associated with a foresole portion of the sole with one foresole tube element located laterally to the other foresole tube element.

6. The sole of claim 5, wherein the tube element is subdivided into tube element portions.

7. The sole of claim 3, wherein the tube element is subdivided into tube element portions.

8. The sole of claim 3, wherein the tube element includes a longitudinal partition which extends a length of the element subdividing the tube element into two chambers and having at least one opening therein so that the two chambers are in communication with each other.

* * * * *